US011162317B2

(12) United States Patent
Zaragoza Labes

(10) Patent No.: US 11,162,317 B2
(45) Date of Patent: Nov. 2, 2021

(54) MODULAR VERTICAL WET CHRISTMAS TREE, INSTALLATION METHOD AND INTERVENTION METHOD THEREOF

(71) Applicant: FMC TECHNOLOGIES DO BRASIL LTDA, Rio de Janeiro (BR)

(72) Inventor: Alan Zaragoza Labes, Rio de Janeiro (BR)

(73) Assignee: FMC TECHNOLOGIES DO BRASIL LTDA, Rio de Janeiro (BR)

( * ) Notice: Subject to any disclaimer, the term of this patent is extended or adjusted under 35 U.S.C. 154(b) by 0 days.

(21) Appl. No.: 16/618,762

(22) PCT Filed: Apr. 24, 2018

(86) PCT No.: PCT/BR2018/050127
§ 371 (c)(1),
(2) Date: Mar. 24, 2020

(87) PCT Pub. No.: WO2018/218322
PCT Pub. Date: Dec. 6, 2018

(65) Prior Publication Data

US 2020/0224510 A1 Jul. 16, 2020

(30) Foreign Application Priority Data

Jun. 1, 2017 (BR) ..... 102017011687-5

(51) Int. Cl.
*E21B 33/035* (2006.01)
*E21B 33/038* (2006.01)
(Continued)

(52) U.S. Cl.
CPC ..... *E21B 33/0355* (2013.01); *E21B 33/0385* (2013.01); *E21B 33/04* (2013.01);
(Continued)

(58) Field of Classification Search
CPC .. E21B 33/0355; E21B 33/0385; E21B 33/04; E21B 33/076; E21B 34/04; E21B 43/122; E21B 47/117
See application file for complete search history.

(56) References Cited

U.S. PATENT DOCUMENTS 4,848,473 A * 7/1989 Lochte ..... E21B 34/04 166/344
5,010,956 A * 4/1991 Bednar ..... E21B 34/04 166/344
(Continued)

FOREIGN PATENT DOCUMENTS

CN 201778730 U 3/2011
EP 0527619 A1 2/1993
(Continued)

OTHER PUBLICATIONS

International Search Report issued in International Application No. PCT/BR2018/050127 dated Jul. 11, 2018 (4 pages).
(Continued)

*Primary Examiner* — Matthew R Buck
(74) *Attorney, Agent, or Firm* — Osha Bergman Watanabe & Burton LLP

(57) ABSTRACT

A wet Christmas tree (WCT) is segmented into a lower safety module containing safety valves and an upper multifunctional module for controlling the flow and/or pumping and/or subsea processing. The WCT can be applied to completion systems using completion mode with tubing heads or directly on the wellhead. The modular WCT can be used in oil and gas production well applications or injection of water and/or gases in subsea fields in shallow water to deep water.

20 Claims, 16 Drawing Sheets

(51) Int. Cl.

| | |
|---|---|
| ***E21B 34/04*** | (2006.01) |
| ***E21B 47/117*** | (2012.01) |
| ***E21B 33/04*** | (2006.01) |
| ***E21B 33/076*** | (2006.01) |
| ***E21B 43/12*** | (2006.01) |

(52) U.S. Cl.
CPC ..... *E21B 33/076* (2013.01); *E21B 34/04* (2013.01); *E21B 43/122* (2013.01); *E21B 47/117* (2020.05)

(56) References Cited

U.S. PATENT DOCUMENTS

| | | | | |
|---|---|---|---|---|
| 5,299,641 | A | 4/1994 | Paulo et al. | |
| 5,971,077 | A * | 10/1999 | Lilley | E21B 33/035 166/348 |
| 7,647,974 | B2 * | 1/2010 | Fenton | E21B 33/035 166/368 |
| 8,672,038 | B2 * | 3/2014 | Tan | E21B 33/035 166/344 |
| 9,145,750 | B2 * | 9/2015 | Borsheim | E21B 33/0355 |
| 10,808,483 | B2 * | 10/2020 | Hosie | E21B 34/02 |
| 2014/0299328 | A1 | 10/2014 | Ray et al. | |
| 2018/0195362 | A1 * | 7/2018 | Slater | E21B 33/06 |

FOREIGN PATENT DOCUMENTS

| | | | | |
|---|---|---|---|---|
| GB | 2400128 | A | 10/2004 | |
| GB | 2539703 | A | 12/2016 | |
| WO | 9749892 | A1 | 12/1997 | |
| WO | WO-2017137622 | A1 * | 8/2017 | E21B 33/035 |

OTHER PUBLICATIONS

Written Opinion issued in International Application No. PCT/BR2018/050127 dated Jul. 11, 2018 (6 pages).

* cited by examiner

MODULAR VERTICAL WET CHRISTMAS TREE, INSTALLATION METHOD AND INTERVENTION METHOD THEREOF

FIELD OF THE INVENTION

The present invention relates to a wet Christmas tree (WCT) segmented into lower safety module and upper multifunctional module for controlling the flow and/or pumping and/or subsea processing.

BACKGROUND OF THE INVENTION

Vertical Wet Christmas Trees are well safety subsea equipment made up of core components, such as main valve block (MVB), chemical injection and hydraulic control valves in the WCT and the well, hydraulic connector, ROV panel, multiplexed system (Subsea Control Module—SCM) and internal hydraulic and electrical distribution systems.

The main valve block consists of a single spool in which all safety valves of the production line are housed. The valves are: PMV (Production Master Valve), PSV (Production Swab Valve) and PWV (Production Wing Valve) in the production flowline and the AMV (Annulus Master Valve), ASV (Annulus Swab Valve) and AWV (Annulus Wing Valve) valves in the annulus flowline.

Other locking valves may be present in this main valve block, such as the crossover (communication) valve between production and annulus lines and the hydraulic control valves are also present to serve as a control for the well safety valves (Downhole Safety Valve—DHSV), as hydraulic connector and for secondary functions in the WCT.

The hydraulic connector is the component which allows vertical connection to the tubing head or the wellhead. It has a hydraulic locking and unlocking being connected to the WCT hydraulic (direct or multiplexed) control system.

The WCT cover is installed on the top of the main valve block, with the operation occurring after the conclusion of the WCT completion step. This cover works as a second barrier between the production flowline and the external environment, with the PSV (Production Swab Valve) valve being an intermediate barrier.

Traditionally, WCT can receive a flow control module connected laterally and externally to WCT by vertical or horizontal connector. This flow control module can have its functionalities directed to production and/or injection mode. Generally, this type of module is equipped with a multiphase meter (type: production mode) and/or single-phase meters (type: injection mode), and flow control choke-like valves, pressure and temperature sensors, acoustic sand detectors and erosion sensors may also be present, among other line blockage remediation and control equipment as specified by the supplier or operator requirement.

Vertical WCT traditionally consists of an integral master valve block, wherein the production flowline valves (PMV, PSV and PWV) and the annulus flowline valves (AMV, ASV and AWV or AAV (Annulus Vent valve)), as well as other chemical injection valves, the control valves and the temperature and pressure sensors and the hydraulic connector (44) is located at the lower end of the block. The multiphase meter and the choke valve are included in a module, called flow module, which presents the characteristic of being removable and being mounted on the WCT side.

The re-entry mandrel contains the WCT cover (tree cap) housing, which contains seals to seal the production and/or annulus lines, and functions as an additional barrier to WCT after the production swab valve.

In general, this type of arrangement results in a nonimproved vertical WCT with respect to weight and size. It requires larger storage areas, larger assembly cells, larger storage spaces in shipyards, probes and vessels. In addition, difficulties in handling and mooring vessels due to their size.

Another important point is that, for traditional WCT, in case of any failure in the functionality, it is necessary to disconnect the flowline in case of having the flowline hub located in WCT, and to proceed with the WCT removal, which results in a higher operating cost for the customer.

BRIEF DESCRIPTION OF THE INVENTION

The present invention relates to the vertical wet Christmas tree (WCT) (10) segmented into upper (02) and lower (04) modules, as can be seen in FIG. 1. The present invention can be used for oil and gas production wells or water and/or gas injection and is used in tubing head completion systems or seated directly on the wellhead.

The lower safety module (04) contains safety valves provided in the production flowline and the annulus flowline. The upper multifunctional module (02) integrates all the multiphase measurement functions and all control accessories necessary for monitoring the produced fluid and flow control of the production line.

Such module arrangement allows an optimization in the installation and intervention of the WCT and allows a more optimized production and injection system.

BRIEF DESCRIPTION OF THE FIGURES

The present invention can be well understood from the accompanying illustrative figures, which, in a schematic and non-limiting way of their scope, represent:

FIG. 6—Diagram of the production flow and the well shut-in.

FIG. 7—Diagram of the injection flow and the well shut-in.

DETAILED DESCRIPTION OF THE INVENTION

Figure 1:
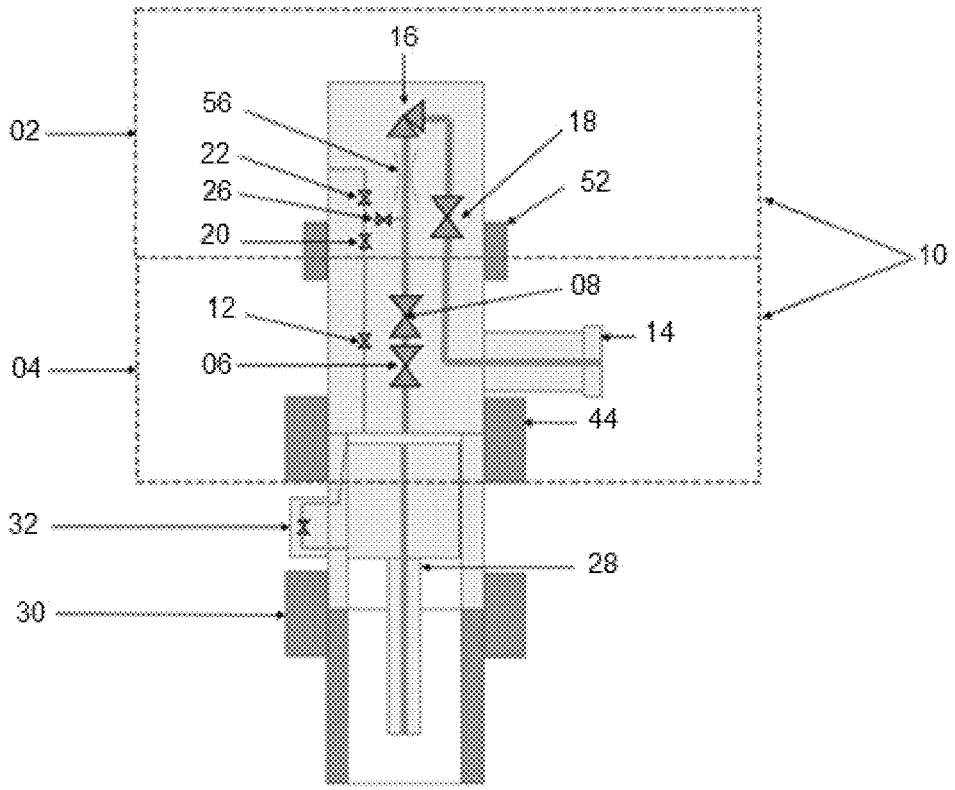
FIG. 1—functionality diagram of WCT.
Figure 2:
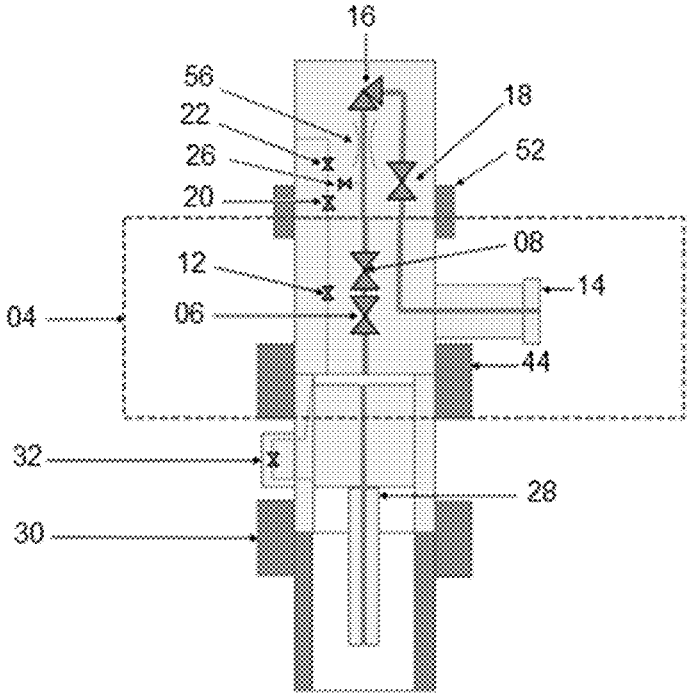
FIG. 2—Diagram of the WCT lower safety module.

The present invention relates to the vertical wet Christmas tree (WCT) (10) segmented into upper (02) and lower (04)

modules, as can be seen in FIG. 1. The lower safety module (04), as can be seen in FIGS. 1 and 2, comprises PMV (06) (Production Master Valve) and PSV (08) (Production Swab Valve) safety valves in the production flowline and ASV (12) (Annulus Swab Valve) safety valve in the annulus flowline, in addition, this module is equipped with a connection system and metal sealing ring which provides a barrier between the well and the external environment (sea water), preserving the philosophy of subsea safety equipment. The hub (14) of the production flowline is also present in the lower safety module (04), as well as the horizontal or vertical connection guide system of the flowline jumper (42) and can also contain an additional production flow valve block (optional), known as shut-down valve.

Figure 3:
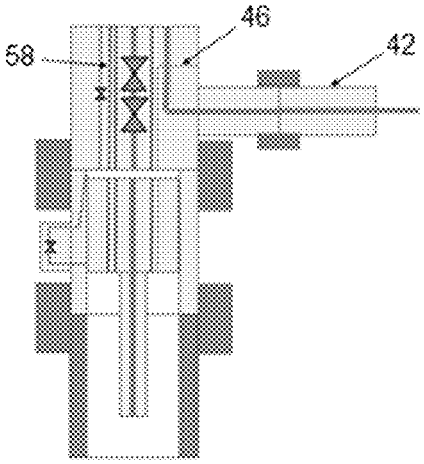
FIG. 3—Diagram of the WCT lower safety module provided with EFS and chemical injection lines.

The lower safety module (04) is still prepared to receive the wellhead electrical connectors (46) (EFS—Electric Feedthrough System or Fiber Optic), shown in FIG. 3, and may contain other penetrations related to chemical injection functions in annulus/flowlines, well chemical injection or well function hydraulic control or further pressure and pressure/temperature sensors.

Figure 4:
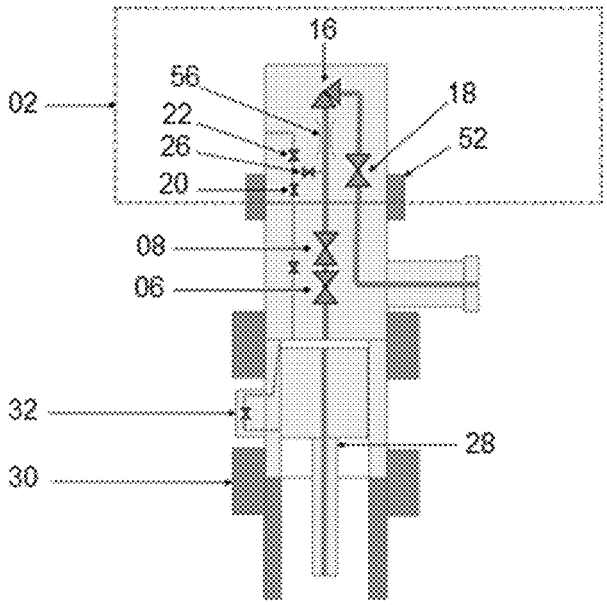
FIG. 4—Diagram of the upper multifunctional module of the WCT.

FIG. 4 shows the schematics of the upper multifunctional module (02) that integrates all the multiphase measurement functions and all the necessary control accessories for monitoring the produced fluid and controlling the flow of the production line through a choke valve (16) containing a PWV (18) with the primary function of blocking the flow in the production line and protecting PSV (08) and PMV (06).

The upper multifunctional module (02) can be equipped with a flow and control system for the artificial gas lift method in an arrangement which may have an injection hub by horizontal or vertical connection, a choke valve (16) and/or multiphase meter (56) (multiphase flowmeter—MPFM) connected to the annulus access line of the upper multifunctional module (02) through which the gas injection flow reaches the annulus flowline (bore) in a downward direction through the security lower safety module (04), continuing up to the gas lift mandrel installed in the well.

The upper multifunctional module (02) can be equipped with a chemical injection system for hydrate, scale, corrosion, paraffin prevention, etc., through an arrangement which may have an injection hub by horizontal or vertical connection, a dosage valve and/or multiphase meter connected to the annulus access line of the upper multifunctional module (02) through which the chemical injection flow reaches the annulus flowline (bore), communication (crossover) line (bore) through the XOV (26) (crossover valve) between annulus and production and annulus line (bore), allowing the cleaning of such flowlines in addition to the export/interconnection line (flowline jumper (42)), if necessary.

Figure 5:
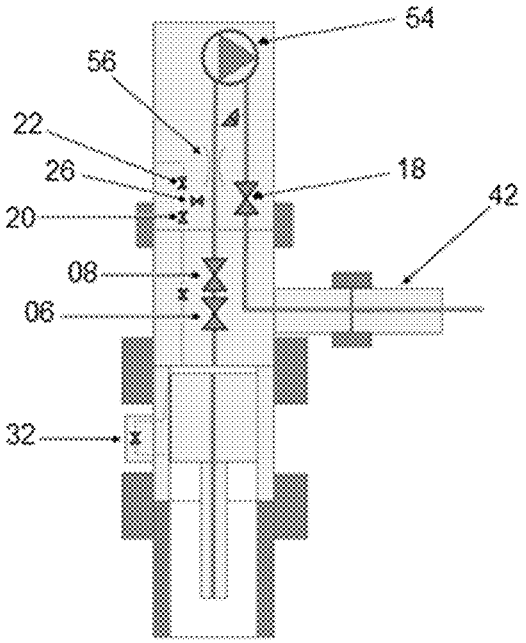
FIG. 5—Diagram of the upper multifunctional module provided with a subsea multiphase pump.

The upper multifunctional module (02) can be equipped with a subsea multiphase pump (54), seen in FIG. 5, wherein the functions of multiphase meter, PWV (18) and AMV (20), AWV (22) and XOV (26) may be integrated, with flow control being managed through the subsea pump (54) in order to maximize the production/injection flow rate.

The upper multifunctional module (02) can also be equipped with a primary subsea processing system in which the multiphase meter, PWV (18) and AMV (20), AWV (22) and XOV functionalities may or may not be integrated. (26). This upper multifunctional module (02) with a processing system can include a multiphase separator allowing the separation of oil, gas and water, with the oil being exported by the production flowline and the water and/or gas being exported through the lateral service line of the annulus. This system also has the flexibility to receive and inject water or gas.

Figure 6:
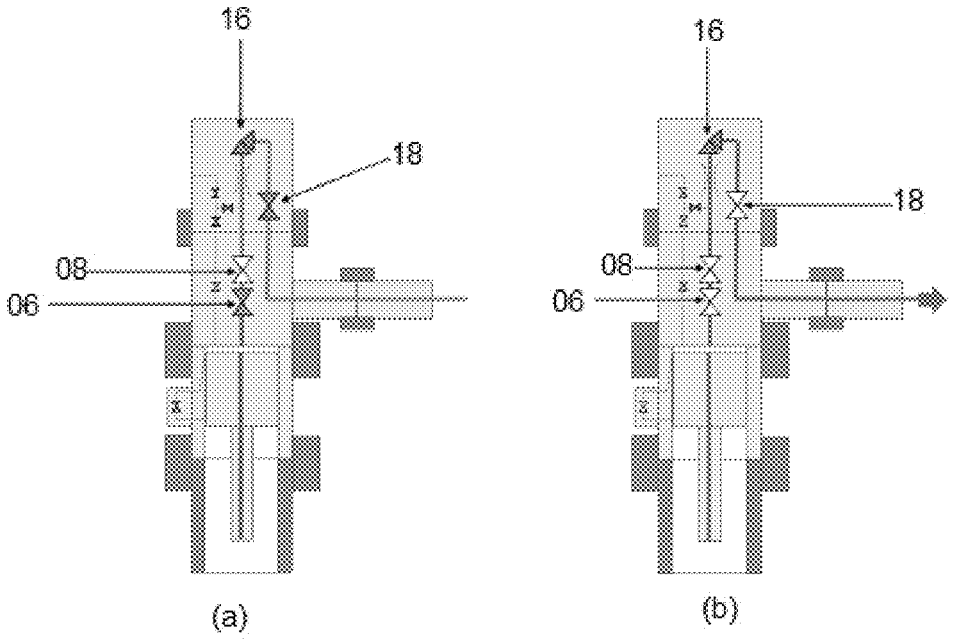

WCT's characteristic is to guide the upward production flow from the well, passing through the column hanger (tubing hanger) (28) and following the production flowline (bore) of the security lower safety module (04) continuing through the upper multifunctional module (02) of the modular multifunctional WCT (10). As can be seen in FIG. 6, the WCT upper multifunctional module (02) has a production flowline (bore) aligned with the line having the same functionality of the lower safety module (04) allowing an upward production flow. This production flowline has a continuous 180° return through the same body (spool) directing this flow to a downward condition leaving the upper multifunctional module (02). This output line is aligned with the secondary production flowline (bore) of the WCT lower safety module (04), followed by the export/injection line (flowline jumper (42)).

FIG. 6(*a*) represents the situation of shut-in well (interruption of production flow), in which the PMV (06) and PWV (18) valves are closed. FIG. 6(*b*) represents the situation of the production well with flow regulation by choke valve, in which the PMV (06), PSV (08) and PWV (18) valves are open.

Figure 7:
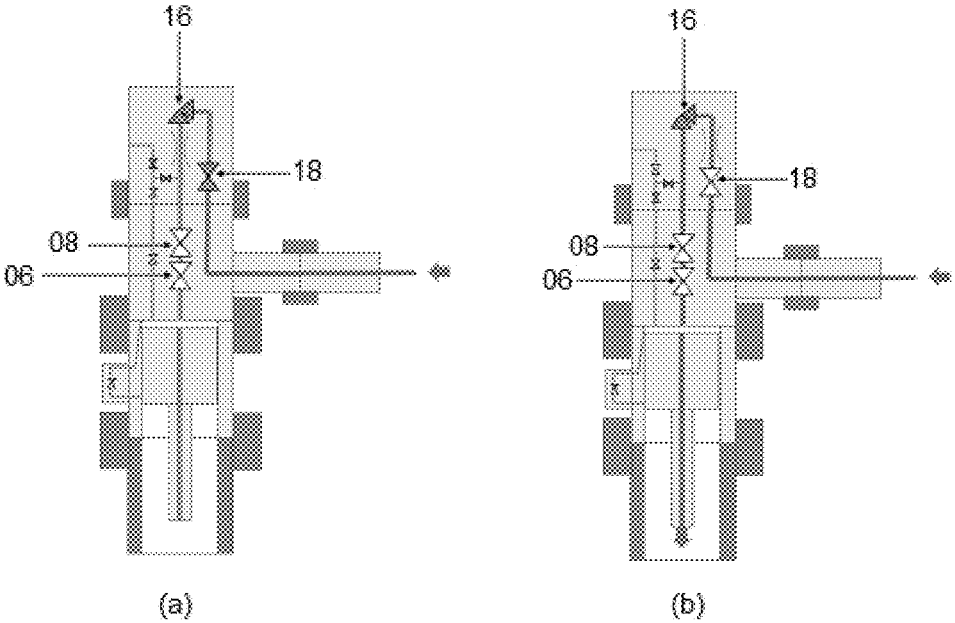

As can be seen in FIG. 7, in the same way as the production flow mode, the injection flow coming through the export/injection line (flowline jumper (42)) follows in reverse flow passing first through the secondary production flowline (bore) of the WCT security lower safety module (04), then it is sent to the upper multifunctional flow module in an upward flow, where it has a continuous 180° return through the same body (spool) directing this flow to a downward condition leaving the upper multifunctional module (02). This output line is aligned with the primary production flowline (bore) of the WCT security lower safety module (04), wherein the flow goes through the tubing hanger (28) up to the bottom of the well.

FIG. 7(*a*) represents the shut-in well (interrupted flow injection) and the PMV (06) and PWV (18) valves are closed. FIG. 7(*b*) represents the situation of a production well with flow regulation made by choke valve, in which the PMV (06), PSV (08) and PWV (18) valves are open.

The modular WCT can be installed in completion configurations with wellhead (30) or with tubing head (32).

The installation sequence disclosed below shows the completion configuration with tubing head (32) and how this concept is advantageous in relation to the installation of a conventional vertical WCT.

Figure 8:
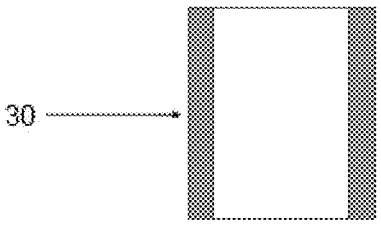
FIG. 8—Diagram of the wellhead.

The wellhead (30), as can be seen in FIG. 8, is firstly installed and afterwards, the tubing head (32) with its BOP adapter spool (34) already coupled are installed on the top of the wellhead (30). The BOP adapter spool (34) is attached to the top of the tubing head (32) through a hydraulic connector (44).

Figure 9:
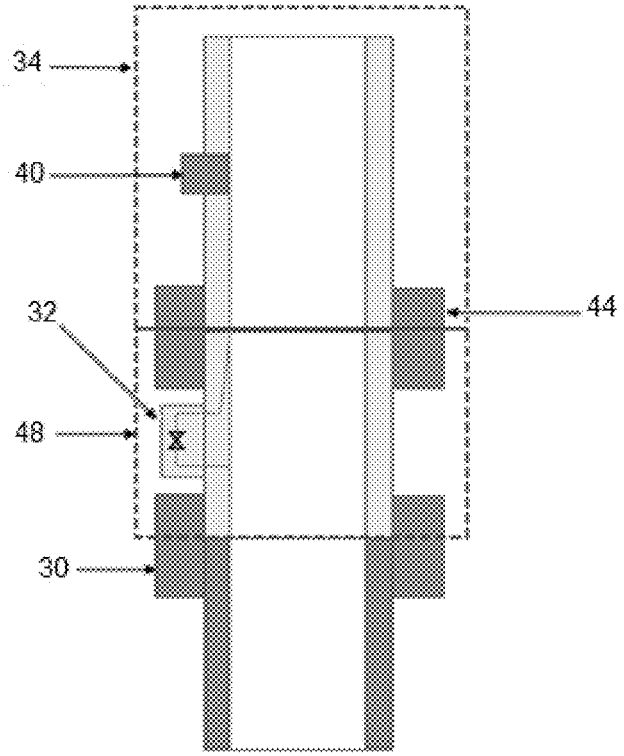
FIG. 9—Diagram of the tubing head and BOP adapter spool set installation.

The installation of the set can be carried out by cable ferry operation, since the envelope dimensions of the stack-up (48) (in this case tubing head (32) and BOP spool adapter (34)) and the weight of this set meet this kind of operation, these elements can be seen in FIG. 9. In the case of using a compact head tubing (32) in this type of arrangement, the gains are maximized due to the possibility of using a smaller vessel.

Figure 10:
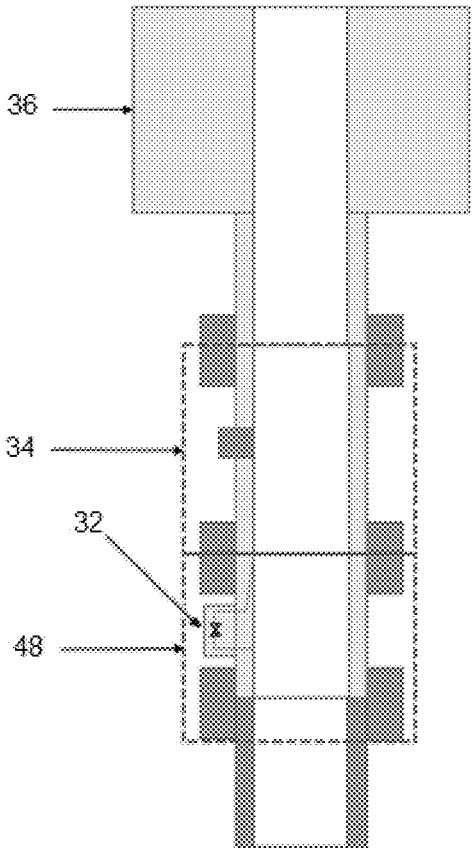
FIG. 10—Diagram of BOP installation.

The BOP spool adapter (34) is coupled to the top of the tubing head (32) through a hydraulic connector (44), as shown in FIG. 9. After the BOP spool adapter (34) and tubing head (32) set are seated, it is verified if the locking of the tubing head connection system (32) is correct. The BOP (36) (blow out preventer) is installed and locked on the top of the adapter (adapter spool), as can be seen in FIG. 10. In this phase, the correct locking of the BOP (36) and the verification of the metal ring sealing are verified, as well as BOP (36) primary tests.

Figure 11:
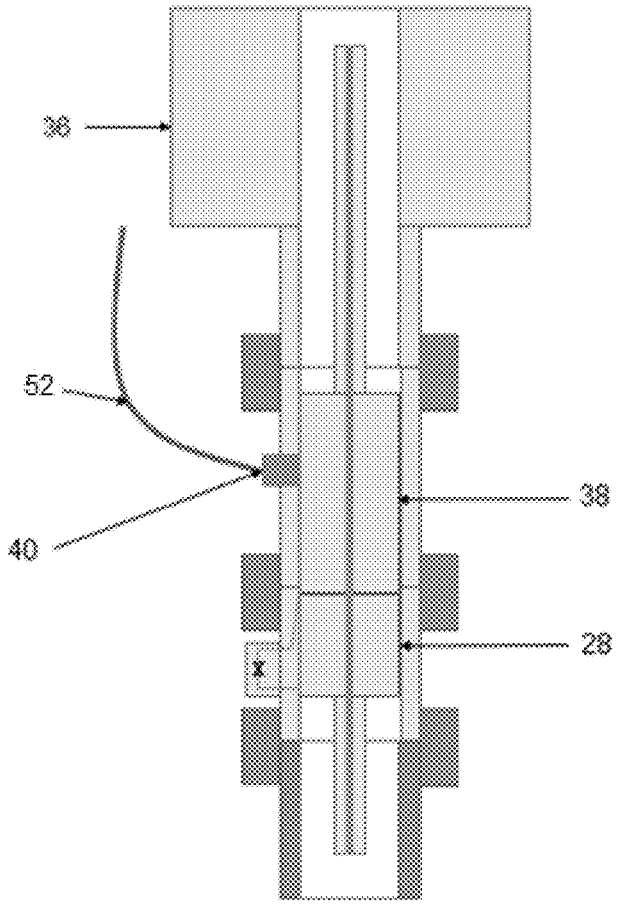
FIG. 11—Diagram of the THRT and TH downhill operation and TH settlement.

The next operation consists in bringing down the tubing hanger (28) installation tool set and the tubing hanger coupled thereto (28). The electrical, hydraulic or electrohydraulic supply to control the functions of the tubing hanger (tubing hanger running tool—THRT) (38) installation/removal tool and the tubing hanger (TH) (28) is provided by an external jumper (52) connected to the BOP adapter spool (34) through a lateral penetration in the spool (40), as can be seen in FIG. 11. After settling and testing the TH (28), the THRT (38) is removed, as can be seen in FIG. 12.

Figure 12:
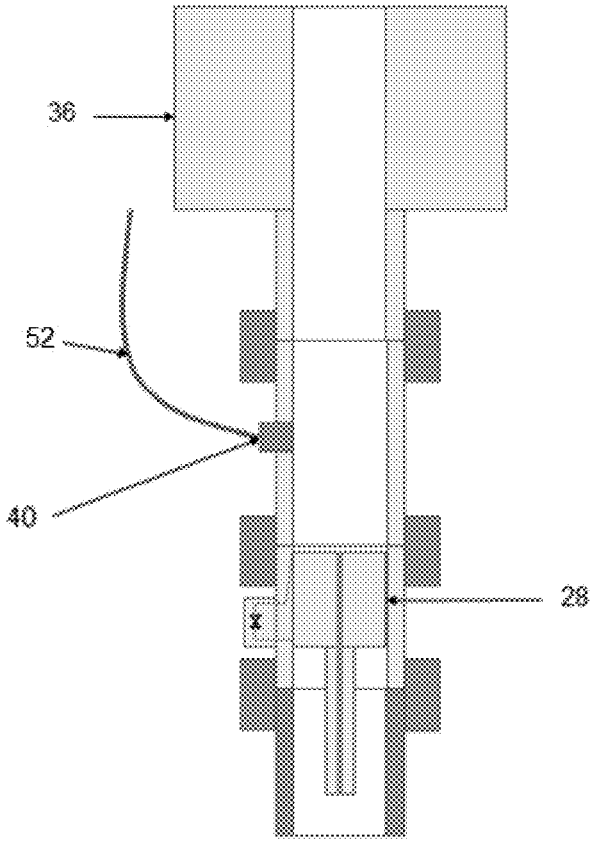
FIG. 12—Diagram of THRT removal.
Figure 13:
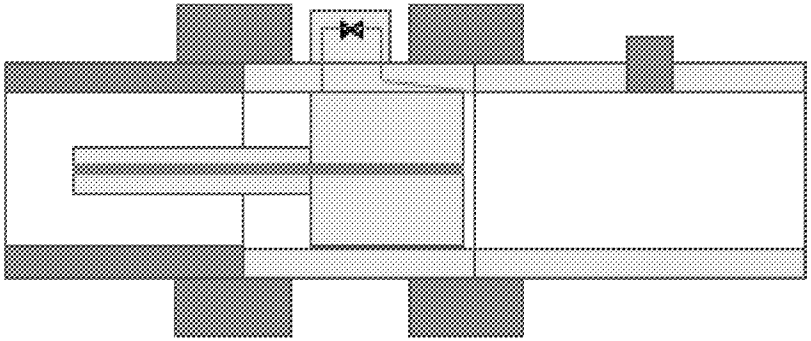
FIG. 13—Diagram of the removal of the electrohydraulic jumper and the BOP from the spool adapter.

After settling and testing the TH (28), the THRT (38) is removed, as can be seen in FIG. 12. After removing the THRT (38), the external electrical and hydraulic or electrohydraulic jumper (52) are removed from the BOP spool adapter (34). Subsequently, BOP (36) is removed from the top of the spool adapter (34), as can be seen in FIG. 13.

Figure 14:
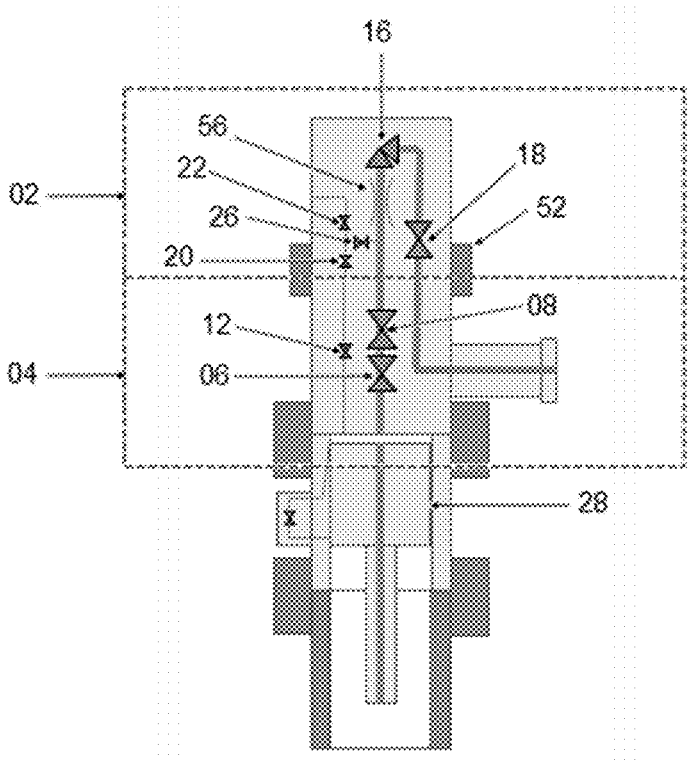
FIG. 14—Diagram of the modular WCT installation.

After removing the BOP (36), the modular WCT (10) is installed on the top of the tubing head (32). In this phase, the connection and verification test of the sealing of the metal sealing ring between WCT and tubing head occurs (32, FIG. 14 outlines the WCT installed with the lower block (02) and the upper block (04)).

Figure 15:
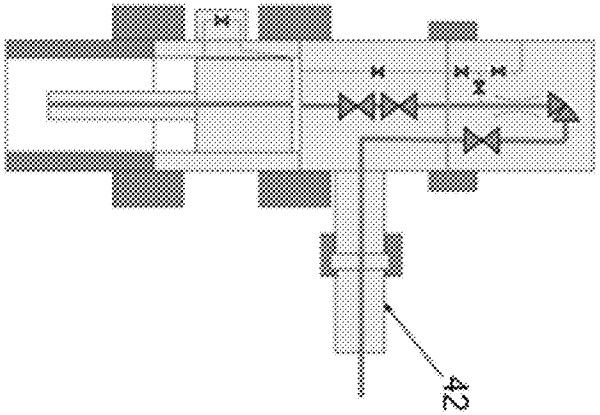
FIG. 15—Diagram of the flowline jumper installation operation in the WCT.

FIG. 15 shows that after WCT installation, the export/injection line jumper (flowline jumper (42)) is installed on the WCT by horizontal or vertical connection, making connection with other equipment on the subsea field.

The main feature of this modular WCT (10) is to comprise most of its functionalities in the upper multifunctional module (02), including those that are more susceptible to wear, erosion or maintenance (ex: flowmeter, sensors, choke, etc.). It allows flexibility in intervention operations and can be carried out by a probe cable or medium or small vessels. In case of replacement of the upper multifunctional module (02), it is necessary to close the PMV (06) and PSV (08) valves on the WCT security lower safety module (04), for a safe disconnection of the upper multifunctional module (02).

Figure 16:
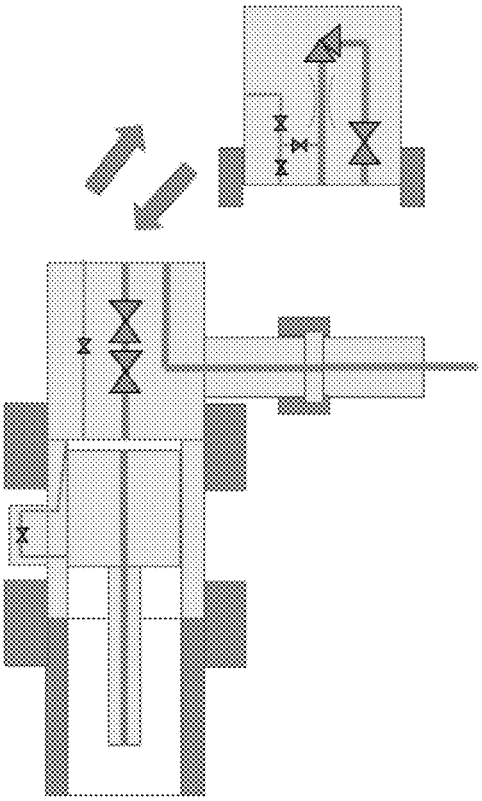
FIG. 16—Diagram of the intervention operation in the WCT.

This type of operation has the advantage of removing the upper multifunctional module (02) without having to disconnect the export/injection line (flowline jumper (42)), as can be seen in FIG. 16. Therefore, the operating time is shorter than for removing a conventional WCT.

Figure 17:
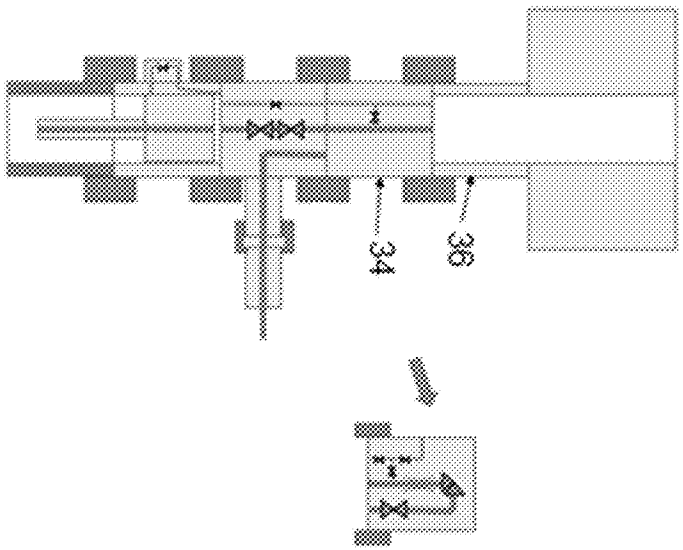
FIG. 17—Diagram of the intervention operation in the WCT with BOP and BOP spool adapter.

In the case of intervention, vertical access to the well is only possible by removing the upper multifunctional module (02), since it includes the functionality of an WCT cover, outlined in FIG. 17. Then it would be necessary to re-enter the BOP (36) and the BOP spool adapter (34) onto the top of the WCT security lower safety module (04).

The upper multifunctional module (02) could be removed directly to the probe or vessel or even be placed in a temporary subsea structure (parking frame) awaiting the intervention operation. At the end of the intervention operation, the WCT upper multifunction module (02) would be reinstalled on the top of the WCT security lower safety module (04).

The vertical modular WCT has great advantages when compared to conventional vertical WCT or even horizontal WCT.

With the upper multifunctional module (02) integrating the functionalities of the flow module, WCT cover and still integrating some conventional WCT valves and actuators, we have a project with a smaller number of components which results in a more efficient management of the equipment parts along the WCT production chain, that is, lower cost and higher productivity.

Another advantageous aspect is that this integration can confer on this type of equipment a reduction in the envelope dimensions and weight when compared to conventional WCT. Therefore, with the reduced size and weight, smaller areas may be required in the equipment assembly and storage cells in industrial parks, storage facilities and ports, in vessels and in drilling/completion probes.

Another advantage of this type of arrangement is that configurability can be performed on the upper multifunctional module (02). In other words, this upper multifunctional module (02) can be designed for production, injection or even the inclusion of facilities that enable some methods of artificial lift, such as gas lift or even multiphase pumping, providing versatility to the customer, which can employ this WCT in the most varied applications in new or mature fields.

Another positive point of this type of arrangement is that the upper multifunctional module (02) can be designed to contain most of the WCT functionalities in a compact module, mainly containing those functionalities most likely to wear and erode, or those known to require more frequent periodic maintenance.

Still analyzing the upper multifunctional module (02), in case of being removed for maintenance, it could easily be replaced by another module and proceed with the production/injection operations, without the need to remove the flowline jumper (42). It is important to note that a compact module like this enables installation and intervention operations to be carried out with the support of medium and small vessels, reducing OPEX (operational expenditure).

The invention claimed is:

1. A modular vertical wet Christmas tree comprising:

an upper multifunctional module comprising a production master valve (PWV), an annulus master valve (AMV), an annulus wing valve (AWV), and a crossover valve (XOV) and a primary subsea processing system; and a lower safety module comprising a production master valve (PMV) safety valve and a production swab valve (PSV) safety valve disposed in a production flowline of the lower safety module, a hub of the production flowline, and a connector for connecting the lower safety module onto a tubing head supporting a tubing hanger.

2. The modular vertical wet Christmas tree according to claim 1, wherein the lower safety module further includes an annulus swab valve (ASV) safety valve in an annular flowline.

3. The modular vertical wet Christmas tree according to claim 2, wherein the lower safety module is arranged to receive downhole electrical connectors and at least one penetration relating to chemical injection functions in the annulus or flowlines, well chemical injection or well function hydraulic control.

4. The modular vertical wet Christmas tree according to claim 1, wherein the upper multifunctional module is equipped with a flow and control system for providing artificial lift of gas.

5. The modular vertical wet Christmas tree according to claim 1, characterized in that the upper multifunctional module includes at least one of:

a chemical injection system for hydrate, scale, corrosion and paraffin prevention;

a subsea multiphase pump, wherein a multiphase meter, and functionalities of the PWV, the AMV, the AWV and the XOV are integrated within the subsea multiphase pump, with flow control being managed through the subsea multiphase pump; or the subsea primary processing system wherein the multiphase meter, and functions of the PWV, the AMV, the AWV, and the XOV are integrated within the subsea primary processing system.

6. The modular vertical wet Christmas tree according to claim 1, wherein the upper multifunctional module is removable without having to disconnect a flowline jumper.

7. The modular vertical wet Christmas tree according to claim 1, wherein the upper multifunctional module is removable directly to a rig or vessel or a temporary subsea structure.

8. The modular vertical wet Christmas tree according to claim 1 wherein the upper multifunctional module integrates functionalities of a flow module, a wet Christmas tree cover, at least one valve and at least one actuator.

9. The modular vertical wet Christmas tree according to claim 1, wherein the upper multifunctional module is configured for production, injection modes, or artificial lift.

10. The modular vertical wet Christmas tree according to claim 9, wherein the modular vertical wet Christmas tree conducts upward production flow from a well passing through the tubing hanger and following the production flowline of the lower safety module, continuing through the upper multifunctional module.

11. The modular vertical wet Christmas tree according to claim 10, wherein the upper multifunctional module has a production flowline aligned to the production flowline with the same functionality of the lower safety module, allowing upward production flow.

12. The modular vertical wet Christmas tree according to claim 9, wherein the production flowline has a continuous 180° return through a body of the upper multifunctional module.

13. The modular vertical wet Christmas tree according to claim 1, wherein injection flow comes through a flowline jumper and continues in reverse flow through a secondary production flowline of the lower safety module.

14. A method comprising:

installing a modular vertical wet Christmas tree comprising:

installing a wellhead;

installing a tubing head coupled to a blowout preventer (BOP) adapter spool on top of the wellhead, the BOP adapter spool being coupled to a top of the tubing head through a hydraulic connector;

checking a locking of a tubing head connection system;

installing and locking a BOP on top of the BOP adapter spool;

checking the locking of the BOP and checking a metal sealing ring;

performing primary BOP testing;

lowering a tubing hanger running tool and a tubing hanger coupled thereto;

settling the tubing hanger, testing the tubing hanger, and removing the tubing hanger running tool;

after removing the tubing hanger running tool, removing an external electric and hydraulic or electrohydraulic jumper from the BOP spool adapter;

removing the BOP from the top of the BOP adapter spool;

installing the modular vertical wet Christmas tree on the top of the tubing head; and testing a connection and checking sealing of the metal sealing ring between the modular vertical wet Christmas tree and the tubing head.

15. The method according to claim 14, wherein an installation and operation mode can be installed in the wellhead or in the tubing head.

16. The method according to claim 14, wherein the entire method of installing is performed by cable ferry operation.

17. The method according to claim 14, wherein electric, hydraulic or electrohydraulic power for controlling functions of the tubing hanger and the tubing hanger running tool is provided by the external jumper connected to the BOP adapter spool through a lateral penetration in a spool.

18. The method of claim 14, further comprising an intervention operation mode comprising:

closing a production master valve (PMV) and a production swab valve (PSV) on a lower safety module of the modular vertical wet Christmas tree to replace an upper multifunctional module of the modular vertical wet Christmas tree;

re-entering the BOP and the BOP adapter spool onto a top of the lower safety module; and reinstalling the upper multifunctional module on top of the lower safety module.

19. The method according to claim 18, wherein the upper multifunctional module is removable directly to a rig, a vessel, or a temporary subsea structure.

20. The method according to claim 18, wherein the intervention operation mode is performed by rig cable or medium or small vessels.

* * * * *